US006782690B2

(12) United States Patent
Kwan

(10) Patent No.: US 6,782,690 B2
(45) Date of Patent: Aug. 31, 2004

(54) EXPANSIBLE BAND FOR A WATCH OR THE LIKE

(75) Inventor: Wing Cheuk Kwan, Hong Kong (HK)

(73) Assignee: Chung Nam Watch Co., Ltd. (HK)

( * ) Notice: Subject to any disclaimer, the term of this patent is extended or adjusted under 35 U.S.C. 154(b) by 0 days.

(21) Appl. No.: 10/242,450

(22) Filed: Sep. 13, 2002

(65) Prior Publication Data

US 2004/0050032 A1 Mar. 18, 2004

(51) Int. Cl.[7] ..... F16G 13/24
(52) U.S. Cl. ..... 59/79.1; 59/80
(58) Field of Search ..... 59/79.1, 79.3, 59/80; 63/5.1

(56) References Cited

U.S. PATENT DOCUMENTS 1,764,440 A * 6/1930 Gammell et al. ..... 59/80
2,901,895 A * 9/1959 Augenstein et al. ..... 63/5.1
3,307,348 A 3/1967 Vanover
3,344,599 A * 10/1967 Hauser ..... 59/79.1
3,705,490 A * 12/1972 Ripley ..... 59/79.1
4,096,688 A * 6/1978 Rieth ..... 59/79.1

* cited by examiner

*Primary Examiner*—David B Jones
(74) *Attorney, Agent, or Firm*—Burns, Doane, Swecker & Mathis, L.L.P.

(57) ABSTRACT

An expansible band (10) is disclosed as including a first band part (P), a second band part ($Q_1$, $Q_2$) and a third band part (R), each of the band parts including a number of inter-engaged link members (14A, 14B), in which each of the band parts (P, $Q_1$, $Q_2$, R) is movable between an expanded configuration and a stable contracted configuration, and the first band part (P) is releasably engaged with the second band part ($Q_1$, $Q_2$), and the second band part ($Q_1$, $Q_2$) is releasably engaged with the third band part (R).

31 Claims, 4 Drawing Sheets

EXPANSIBLE BAND FOR A WATCH OR THE LIKE

FIELD OF THE INVENTION

The present invention relates to an expansible band which may be used in the malting of watches, bracelets or the like.

BACKGROUND OF THE INVENTION

Expansible bands are already known. One type of such bands is disclosed in U.S. Pat. No. 3,307,348, the contents of which are filly incorporated herein. As the band is expansible, it may be moved between an expanded configuration, e.g. when being pulled over the user's hand, and a filly contracted configuration, to which latter configuration the band is biased. When the band is worn by a user, the band is intended to remain in its stable, fully contracted configuration. The size of the band when in its fully contracted configuration should thus fit the size of the wrist of the user.

It is, of course, well known that different persons have different wrist sizes. However, in existing expansible bands, the length of the bands in their fully contracted configuration cannot be further reduced, without using specialized tools or by experienced technicians. Thus, for example, watch manufacturers cannot stock bands of one size only, but have to stock expansible bands of different sizes, e.g. large, medium and small, for fitting the wrist size of different users. This would create problems for stock management, and add to the cost.

It is thus an object of the present invention to provide an expansible band in which the aforesaid shortcoming is mitigated, or at least to provide a useful alternative to the trade and public.

SUMMARY OF THE INVENTION

According to the present invention, there is provided an expansible band including at least a first, a second and a third band member, each including a plurality of inter-engaged link members, wherein at least said first band member is movable between an expanded configuration and a stable contracted configuration, wherein said first band member is releasably engaged with said second band member, and said second band member is releasably engaged with said third band member.

BRIEF DESCRIPTION OF THE DRAWINGS

A preferred embodiment of the present invention will now be described, by way of an example only, with reference to the accompanying drawings, in which.

DESCRIPTION OF THE PREFERRED EMBODIMENT

Figure 1A:
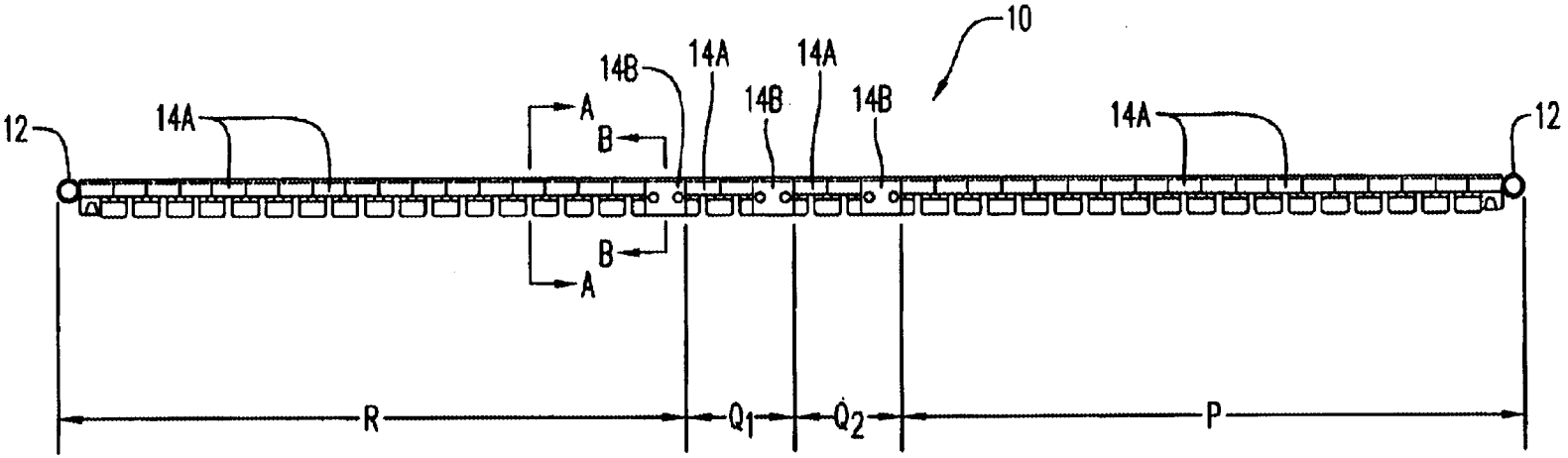
FIG. 1A is a side view of an expansible band according to the present invention.
Figure 1B:
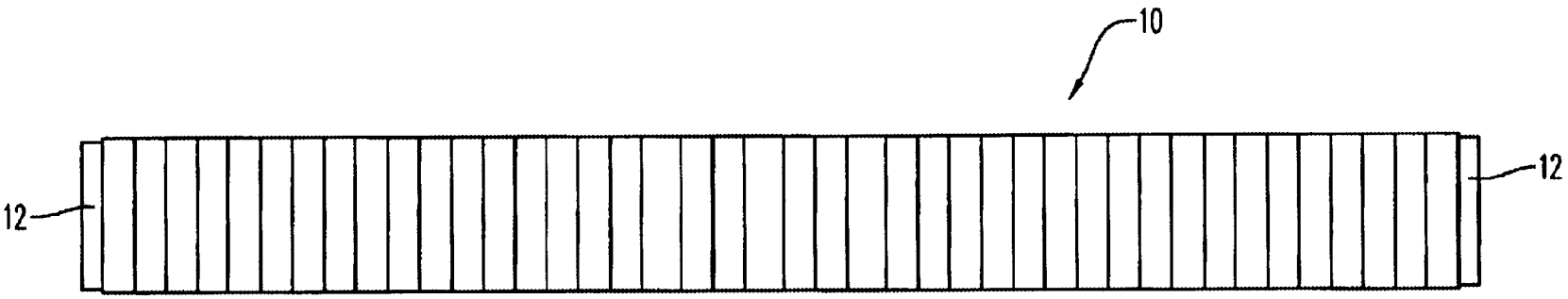
FIG. 1B is a top view of the band shown in FIG. 1A.

An expansible watch band according to a preferred embodiment of the present invention is shown in FIGS. 1A and 1B, generally designated as 10. At each end of the band 10 is provided with a crimped portion 12 adapted to be in engagement with a watch casing (not shown), in the conventional manner. The band 10 is made up of four band parts, P, $Q_1$, $Q_2$ and R, in which the band parts $Q_1$ and $Q_2$ are the same.

Figure 2A:
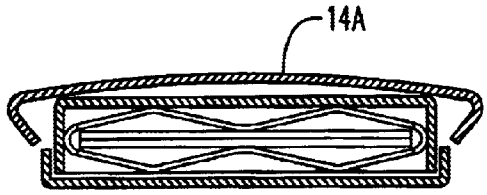
FIG. 2A is a sectional view of a first type of link taken along the line A—A in FIG. 1A.

Each of the band parts P, $Q_1$, $Q_2$ and R is made up of a number of inter-engaging links. The band part P is made up of a number of links 14A inter-engaged with one another to allow the band part P to expand and contract in the conventional manner. In particular, because of the construction of the links 14A, the band part P is biased towards the contracted configuration, which is thus also the stable configuration. A cross sectional view of the link 14A is shown in FIG. 2A. As to the band parts $Q_1$ and $Q_2$, each is made up of a link 14B and a number of links 14A. In this example, the lengths of the band parts $Q_1$ and $Q_2$ are the same. It is of course possible for the lengths of the band parts $Q_1$ and $Q_2$ to be different, or to provide several of such band parts $Q_1$ and $Q_2$, to increase the freedom in adjusting the length of the band 10. Again, the band parts $Q_1$ and $Q_2$ are movable between an expanded configuration and a stable contracted configuration. Turning to the band part R, such is made up of a link 14B engaged with a number of links 14A, again allowing the band part R to expand and contract, in the conventional manner.

Figure 2B:
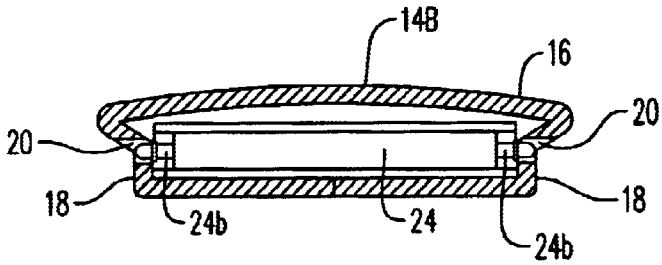
FIG. 2B is a sectional view of a second type of link taken along the line B—B in FIG. 1A.
Figure 2C:
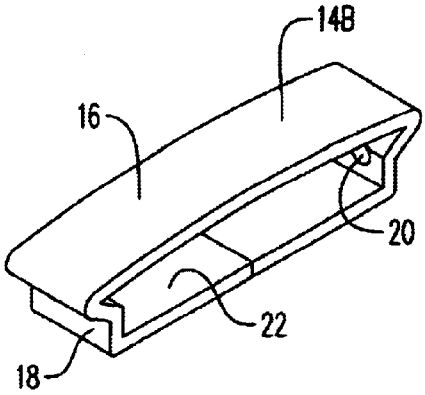
FIG. 2C is a perspective view of the second type of link shown in FIG. 2B, with an engagement pin removed.
Figure 2D:
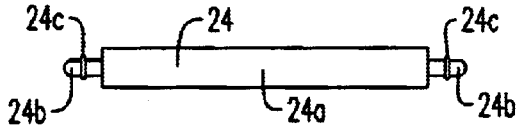
FIG. 2D is a side view of an engagement pin used in the band shown in FIG. 1A.

A cross section view of the link 14B is shown in FIG. 2B, and a perspective view thereof is shown in FIG. 2C. It can be seen that the link 14B has a slightly curved upper surface 16 and two opposite end walls 18. On each end wall 18 is formed two holes 20, of which only part of one is shown in FIG. 2C. The link 14B has a cavity 22 sized and configured to receive an engagement pin 24, a side view of which being shown in FIG. 2D. The engagement pin 24 has a central thicker portion 24*a* and two narrower end portions 24*b*. Each of the end portions 24*b* is movable axially relative to the central portion 24*a* between a retracted position and an extended position. The end portions 24*b* are biased towards the respective extended position by a spring (not shown) in the central portion 24*a*. The extent to which the end portions 24*b* may be moved towards the central portion 24*a* is governed by a respective narrow collar 24*c* extending radially from the respective end portion 24*b*. As shown in FIG. 2B, each of the end portions 24*b* of the engagement pin 24 is received respectively within a hole 20 on the end wall 18 of the link 14B.

Figure 2E:
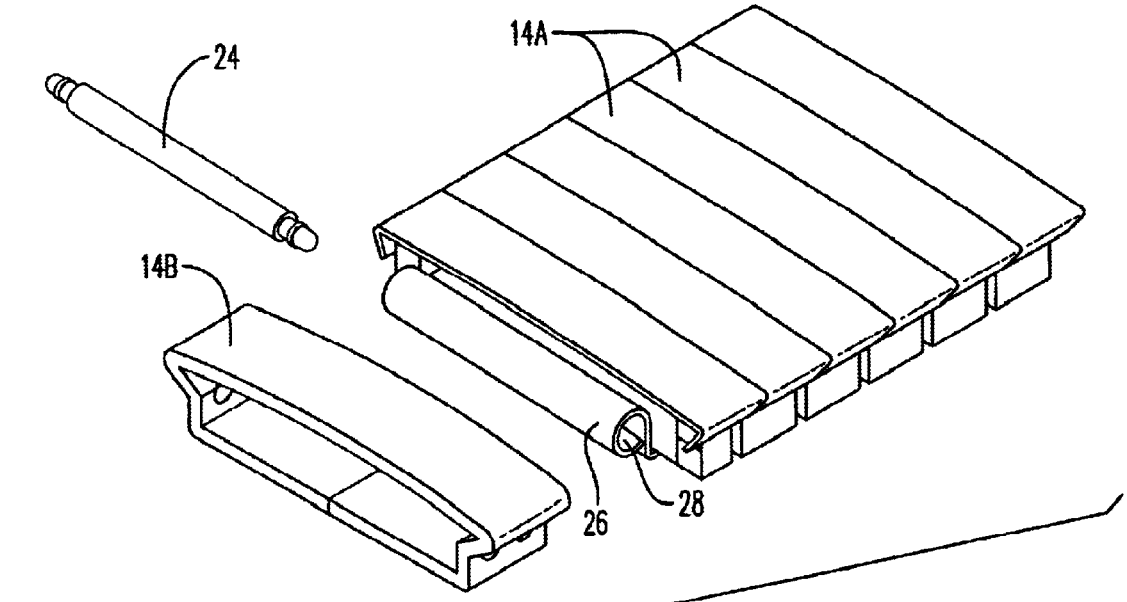
FIG. 2E is a perspective exploded view showing the engagement between the first and second type of links shown in FIGS. 2A and 2B respectively.

FIG. 2E shows in more detail the manner in which the link 14A is engaged with the link 14B. At the link 14A adjacent to the link 14B, a crimped portion 26 is formed to provide a channel 28 for releasably receiving the engagement pin 24. The engagement pin 24 may thus be received within the link 14B for releasable engagement therewith.

Figure 3A:
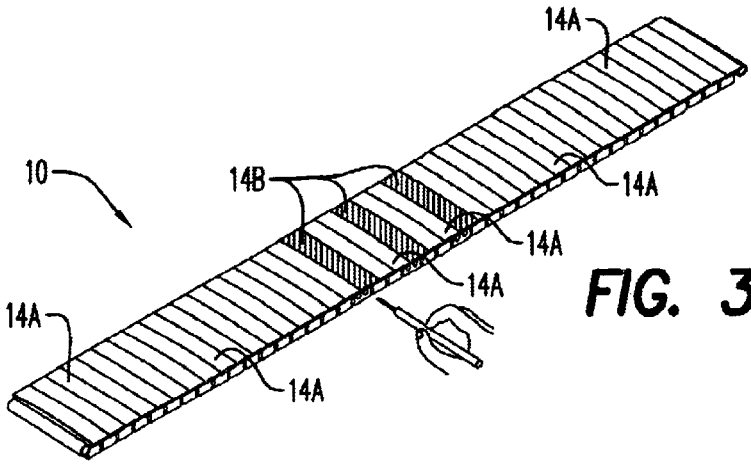
FIGS. 3A to 3C show the manner in which the length of the band shown in FIG. 1A may be adjusted.
Figure 3B:
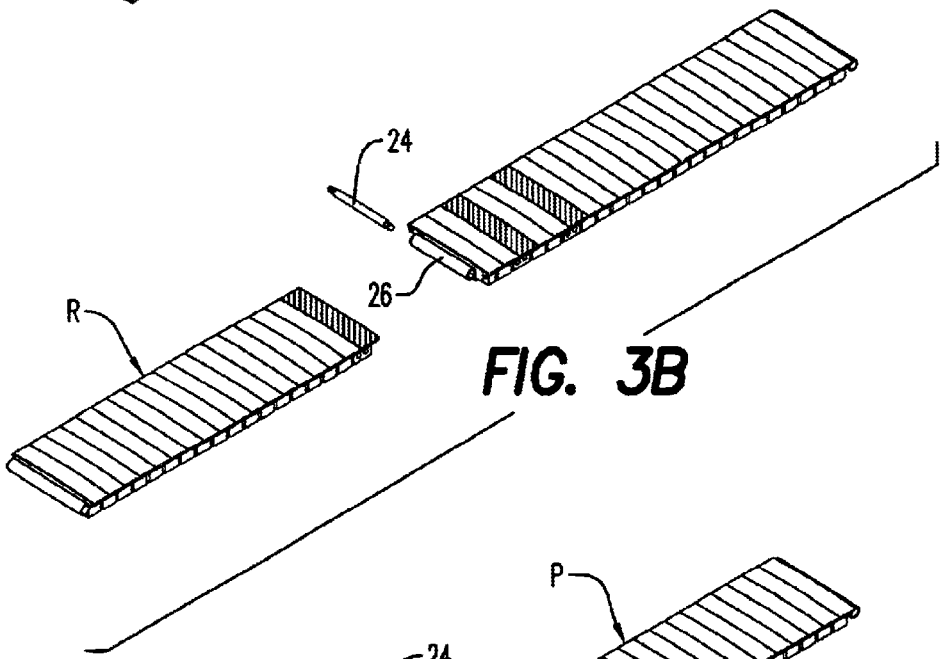
Figure 3C:
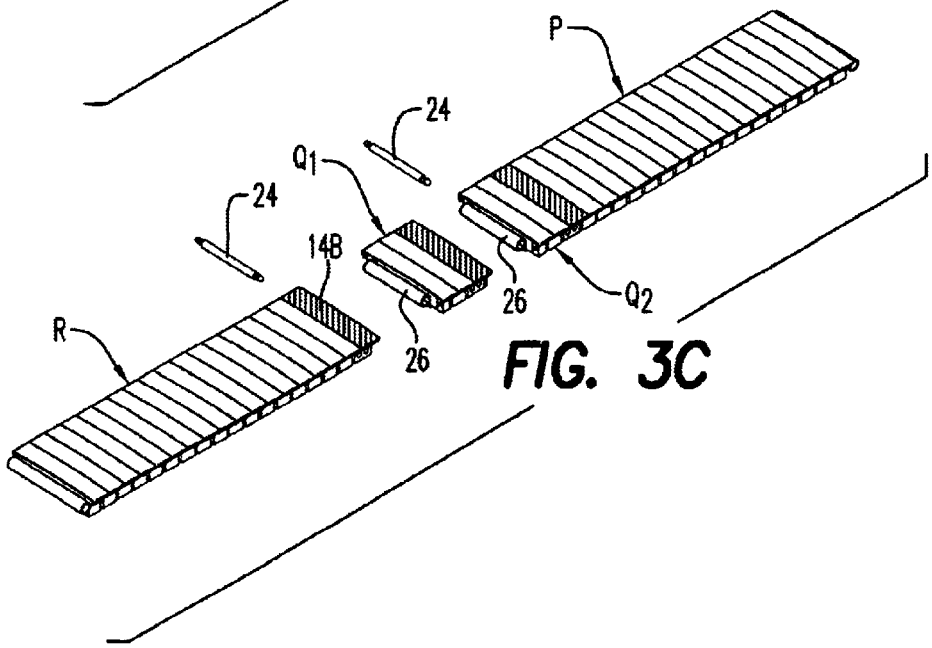

FIGS. 3A to 3C show the manner in which the length of the band 10 may be adjusted. In these figures, in order to enhance clarity, the links 14B are shown as hatched. It should however be appreciated that the outward appearance of the links 14B and 14A may be essentially identical to each other, to provide a homogeneous look.

As shown in FIG. 3A, a user may use an implement with a sharp end to act on one of the end portions 24*b* of the engagement pin 24, against the biasing force of the spring in the central portion 24*a* of the engagement pin 24, and to push the engagement pin 24 slightly sideward. The engagement pin 24, thus out of engagement with one of the holes 20 of the link 14B, will allow the band part R to be detached from the rest of the band 10, as shown in FIG. 3B. If necessary, the engagement pin 24 may also be detached from the crimped portion 26. In the same way, the engagement between the band parts $Q_1$ and $Q_2$ may be released, thus detaching the band part $Q_1$ from the band parts $Q_2$ and P, as shown in FIG. 3C.

The band parts $Q_2$ and P and the band part R may be releasably engaged with each other by having the engagement pin 24 received within the crimped portion 26 of the band part $Q_2$. One end portion 24*b* of the engagement pin 24 is then received within a hole 20 of the link 14B of the band part R Another end portion 24*b* of the engagement pin 24 is then pressed axially towards the central portion 24*a* to allow the engagement pin 24 to be wholly received within the cavity of the link 14B. When the engagement pin 24 is aligned with both the appropriate holes 20, the other end portion 24*b* will move to its extended position under the biasing force of the spring in the engagement pin 24 to engage the other hole 20, and thereby to engage the band part $Q_2$, and thus the band part P with which it is engaged, with the band part R.

If desired, e.g. to further reduce the length of the resultant band, the band part $Q_2$ may similarly be detached from the band part P, and the band parts P and R be releasably engaged with each other.

It can be seen that, by way of the arrangement in the present invention, the length of the band 10 may be easily adjusted, even by the end user, by using a very simple hand implement.

It should be understood that the above only illustrates and describes an example whereby the present invention may be carried out, and that modifications and/or alterations may be made thereto without departing from the spirit of the invention.

It should also be understood that various features of the invention which are, for brevity, described here in the context of a single embodiment, may be provided or separately or in any suitable sub-combination.

What is claimed is:

1. An expansible band including at least a first, a second and a third band member, each including a plurality of inter-engaged link members having end walls, wherein at least said first band member is movable between an expanded configuration and a stable contracted configuration, wherein said first band member is releasably engaged with said second band member, and said second band member is releasably engaged with said third band member via a first resilient engagement member substantially wholly received within a link member of said third band member, an wherein said first resilient engagement member is engaged with an aperture on an end wall of said link member of said third band member.

2. A band according to claim 1 wherein said first band member is adapted to be releasably engaged with said third band member when said second band member is detached from said first and third band members.

3. A band according to claim 1 including a plurality of second band members.

4. A band according to claim 1 wherein said first band member is releasably engaged with said second band member via a second resilient engagement member.

5. A band according to claim 4 wherein said second resilient engagement member includes a pin member with at least an end part movable between a retracted and an extended position.

6. A band according to claim 5 wherein said end part is biased towards said extended position.

7. A band according to claim 5 wherein said second resilient engagement member includes two end parts, each being movable between a retracted and an extended position.

8. A band according to claim 4 wherein said first band member includes a channel member, and said second resilient engagement member is engaged with said channel member of said first band member.

9. A band according to claim 8 wherein said second resilient engagement member is releasably engaged with said channel member.

10. A band according to claim 4 wherein said second resilient engagement member is substantially wholly received within a link member of said second band member.

11. A band according to claim 10 wherein said second resilient engagement member is engaged with an aperture on an end wall of said link member of said second band member.

12. A band according to claim 11 wherein said second resilient engagement member is engaged with two apertures, each on a respective end wall of said link member of said second band member.

13. A band according to claim 12 wherein said link member of said second band member includes two pairs of apertures, each on a respective end wall thereof, whereby said link member of said second band member is engaged with two said second resilient engagement members.

14. A band according to claim 1 wherein said first resilient engagement member includes a pin member with at least an end part movable between a retracted and an extended position.

15. A band according to claim 14 wherein said end part is biased towards said extended position.

16. A band according to claim 14 wherein said first resilient engagement member includes two end parts, each being movable between a retracted and an extended position.

17. A band according to claim 14 wherein said second band member includes a channel member, and said first resilient engagement member is engaged with said channel member of said second band member.

18. A band according to claim 17 wherein said first resilient engagement member is releasably engaged with said channel member.

19. A band according to claim 1 wherein said first resilient engagement member is engaged with two apertures, each on a respective end wall of said link member of said third band member.

20. A band according to claim 19 wherein said link member of said third band member includes two pairs of apertures, each on a respective end wall thereof, whereby said link member of said third band member is engaged with two said first resilient engagement members.

21. A band according to claim 1 wherein said second band member is movable between an expanded configuration and a stable contracted configuration.

22. A band according to claim 1 wherein said third band member is movable between an expanded configuration and a stable contracted configuration.

23. An expansible band including at least first, a second and a third band member, each including a plurality of inter-engaged link members having wall members, wherein at least said first band member is movable between an expanded configuration and a stable contracted configuration, wherein said first band member is releasably engaged with said second band member, and said second band member is releasably engaged with said third band member, wherein said first band member includes at least one male engagement member releasably engaged with at least one female engagement member of said second band member, and wherein said second band member includes at least one male engagement member releasably engaged with at least one female engagement member of said third band member.

24. A band according to claim 23 wherein said at least one male member of said first band member includes a pin member with at least one end portion movable between a stable extended position and a retracted position.

25. A band according to claim 24 wherein said pin member has a pair of end portions each movable between a respective stable extended position and a retracted position.

26. A band according to claim 23 wherein said at least one female engagement member of said second band member comprises an aperture on a wall member of a link member of and second band member.

27. A band according to claim 26 wherein said at least one female engagement member comprises a pair of apertures, each on a respective wall member of a link member of said second band member.

28. A band according to claim 23 wherein said at least one male member of said second band member includes a pin member with at least one end portion movable between a stable extended position and a retracted position.

29. A band according to claim 28 wherein said pin member has a pair of end portions each movable between a respective stable extended position and a retracted position.

30. A band according to claim 23 wherein said at least one female engagement member of said third band member comprises an aperture on a wall member of a link member of said third band member.

31. A band according to claim 30 wherein said at least one female engagement member comprises a pair of apertures, each on a respective wall member of a link member of said third band member.

* * * * *